US008863327B1

(12) United States Patent
Winn

(10) Patent No.: US 8,863,327 B1
(45) Date of Patent: Oct. 21, 2014

(54) FACE CRADLE COVER WITH PROTECTIVE STORAGE ELEMENT

(71) Applicant: Cynthia L. Winn, Louisa, VA (US)

(72) Inventor: Cynthia L. Winn, Louisa, VA (US)

( * ) Notice: Subject to any disclaimer, the term of this patent is extended or adjusted under 35 U.S.C. 154(b) by 0 days.

(21) Appl. No.: 14/198,555

(22) Filed: Mar. 5, 2014

(51) Int. Cl.
*A47G 9/10* (2006.01)

(52) U.S. Cl.
USPC ..... 5/490; 5/622

(58) Field of Classification Search
USPC ..... 5/621–622, 636–638, 630
See application file for complete search history.

(56) References Cited

U.S. PATENT DOCUMENTS

2009/0222986 A1* 9/2009 Hamilton ..... 5/488
2014/0000036 A1* 1/2014 Cohen ..... 5/639

* cited by examiner

*Primary Examiner* — Fredrick Conley
(74) *Attorney, Agent, or Firm* — James M. Smedley, Esq.; James M Smedley LLC

(57) ABSTRACT

The present invention relates to a cover for a massage table face cradle. Specifically, the invention is a fitted cover for a massage table face cradle that further includes a pocket for stowing the cover, providing a barrier between the user from any unprotected and potentially unsanitary areas of massage table and face cradle hardware, providing a secure space to store personal items such as but not limited to scented sachets, aromatherapy, personal items such as jewelry and electronic devices, and transport or storage.

19 Claims, 3 Drawing Sheets

FACE CRADLE COVER WITH PROTECTIVE STORAGE ELEMENT

FIELD OF THE INVENTION

The present invention relates to a cover for a massage table face cradle. Specifically, the invention is a fitted cover for a massage table face cradle that further includes a pocket for stowing the cover, providing a barrier between the user from any unprotected and potentially unsanitary areas of massage table and face cradle hardware, providing a secure space to store personal items such as but not limited to scented sachets, aromatherapy, personal items such as jewelry and electronic devices, and transport or storage.

BACKGROUND OF THE INVENTION

A standard massage table can be generally described as having two main portions: the table top and the face cradle. The design of a standard massage table typically includes a slight gap that exists between the table top and the face cradle. This gap, while providing a place for a person to place their face and/or head during a massage, also includes hardware and connecting brackets that attach the face cradle to the table top. While it is standard practice in the massage industry to clean the massage table between customers, as well as provide clean linens and a cover for the face cradle, the previously mentioned gap is often overlooked and not cleaned between massage customers. As a result, the areas in and around that gap, in particular the front edges of the table top, the rear edges of the face cradle, and the hardware connecting the face cradle to the table top, can become unsanitary as the result of repetitive use. This is of particular concern because it is those areas of the massage table that come into close contact with the eyes, nose, mouth, and face of the person lying on the massage table. While there are existing covers that attach to the face cradle, there is no integrated solution that serves as a cover for both the face cradle while simultaneously serving as a cover for other exposed portions of a massage table, in particular the areas in and around the gap between the front edge of the table top and the face cradle.

Therefore, there is a need in the art for an single, integrated apparatus that can simultaneously cover both the face cradle of a massage table and the other exposed portions of the massage table that are adjacent to the face cradle. These and other features and advantages of the present invention will be explained and will become obvious to one skilled in the art through the summary of the invention that follows.

SUMMARY OF THE INVENTION

The present invention provides a cover for a face cradle on a massage table that is further configured with a protective storage element that is adapted to cover other exposed portions of the massage table that are adjacent to the face cradle. The protective storage element may also be adapted to receive and stow the face cradle cover during storage and transport.

According to an embodiment of the present invention, a face cradle cover with protective storage element, comprising a face cradle cover portion that includes a cover wall configured to envelop a face cradle, one or more cover wall securing means configured to secure the cover wall to the face cradle, and one or more pocket attachment means attached to one or more of an inner surface and an outer surface of the cover wall and a protective storage element formed as a pocket adapted to receive the face cradle cover within the pocket and the protective storage element further including one or more cover portion attachment means attached to one or more of an inner surface and an outer surface of the protective storage element, wherein the one or more cover portion attachment means is adapted to connect the storage pocket to the one or more pocket attachment means of the face cradle cover portion.

According to an embodiment of the present invention, the protective storage element is further adapted to serve as a protective cover for exposed portions of a massage table adjacent to the face cradle.

According to an embodiment of the present invention, the pocket of the protective storage element is further adapted to store items when the face cradle cover portion is in place on the face cradle.

According to an embodiment of the present invention, the one or more cover wall securing means is selected from a group of cover wall securing means comprising an elastic element, a zipper, a one or more clasps, one or more buttons, a one or more hook-and-loop fasteners, or one or more snap closures.

According to an embodiment of the present invention, the one or more pocket attachment means are selected from a group of attachment means comprising hook-and-loop fasteners, buttons, snap closures, claps, and magnets.

According to an embodiment of the present invention, the one or more cover portion attachment means are selected from a group of attachment means comprising hook-and-loop fasteners, buttons, snap closures, claps, and magnets.

According to an embodiment of the present invention, a face cradle cover with protective storage element, comprising a face cradle cover portion, that includes a cover wall configured to envelop a face cradle, one or more cover wall securing means configured to secure the cover wall to the face cradle, and one or more pocket attachment means attached to one or more of an inner surface and an outer surface of the cover wall, and a protective storage element formed as a pocket adapted to receive the face cradle cover within the pocket and the protective storage element further comprising one or more cover portion attachment means attached to one or more of an inner surface and an outer surface of the protective storage element, wherein the one or more cover attachment means is adapted to connect the protective storage element to the one or more pocket attachment means of the face cradle cover portion, wherein the protective storage element is permanently attached to the face cradle cover portion via one or more connection points.

According to an embodiment of the present invention, the one or more connection points is a stitch connecting between the protective storage element and the face cradle cover portion.

According to an embodiment of the present invention, the pocket further comprises an interior lining.

According to an embodiment of the present invention, the interior lining is constructed from a protective material, selected from the group comprising plastic, fabric, linen, vinyl and rubber.

According to an embodiment of the present invention, the protective interior lining is formed to provide a plurality of individual pockets within said pocket.

According to an embodiment of the present invention, the pocket further comprises an exterior lining.

According to an embodiment of the present invention, the exterior lining is constructed from a protective material, selected from the group comprising plastic, fabric, linen, vinyl and rubber.

According to an embodiment of the present invention, the exterior lining is formed to provide a plurality of individual pockets on one or more external walls of said pocket.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED DESCRIPTION OF THE INVENTION

Figure 1:
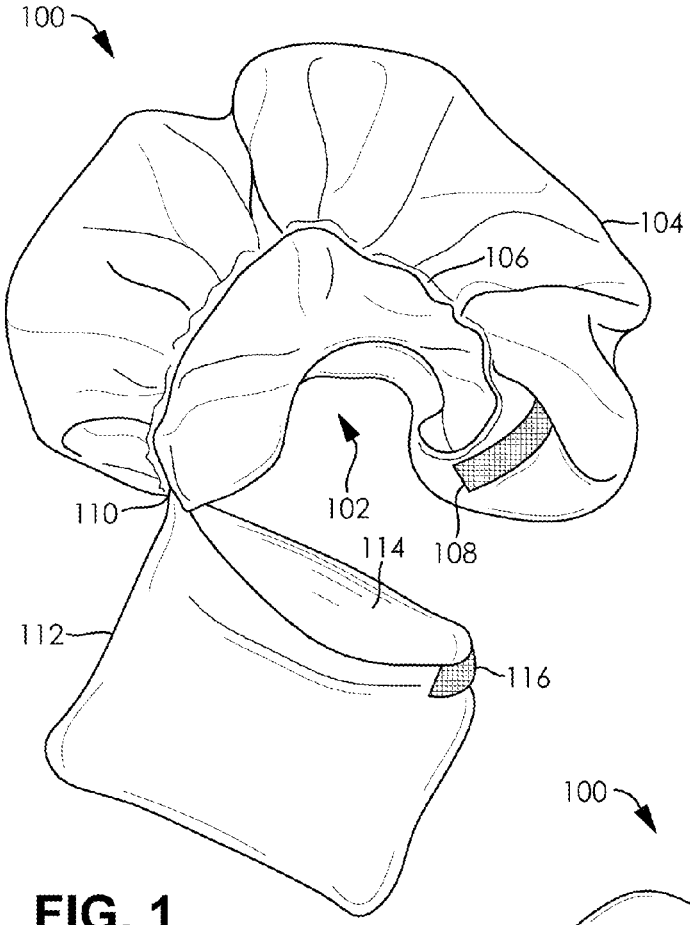
FIG. 1 is a front view of a face cradle cover with protective storage element in accordance with an embodiment of the present invention.

The present invention relates to a cover for a massage table face cradle. Specifically, the invention is a fitted cover for a massage table face cradle that further includes a pocket for stowing the cover during transport or storage, to protect against exposed areas of the table or hardware, and/or for the storage of personal items during a massage session.

According to an embodiment of the present invention, a face cradle cover with protective storage element is primarily comprised of a face cradle cover portion and a protective storage element. In an alternate embodiment, face cradle cover with protective storage element may be comprised of additional or fewer components. One of ordinary skill in the art would appreciate that a face cradle cover with protective storage element could be comprised of a variety of components, and embodiments of the present invention are contemplated for use with any such component.

According to an embodiment of the present invention, a face cradle cover with protective storage element is primarily configured to serve as hygienic cover that is placed over the face cradle and adjacent areas of a massage table. In a preferred embodiment, the face cradle cover portion is primarily adapted to wrap around and envelop the face cradle of a massage table, while the protective storage element is primarily adapted to cover portions of the massage table that are adjacent to the face cradle. In the preferred embodiment, the protective storage element is primarily configured to cover and drape over the front edge of the massage table top, as well as any hardware and supporting elements that connect the face cradle to the massage table. The protective storage element may also cover any gap that exists between the front edge of the table top of the massage table and the back edge of the face cradle. In this way, the combination of the face cradle cover portion and the protective storage element function together to prevent the face, eyes, nose, and/or mouth of a user from coming into direct contact with the surfaces massage table. In the preferred embodiment, the protective storage element may be further configured to stow the face cradle cover portion. One of ordinary skill in the art would appreciate that the face cradle cover with protective storage element could be adapted to function in a variety of form factors, and embodiments of the present invention are contemplated for use with any such form factor.

According to an embodiment of the present invention, a face cradle cover with protective storage element is primarily constructed of a fabric material. In a preferred embodiment, the face cradle cover with protective storage element may be made from any soft, durable fabric. The fabric may be a natural material, such as cotton, or a synthetic material, such as acrylic. In an alternate embodiment, the fabric may be an antibacterial or antimicrobial fabric or a fabric that is treated with an antibacterial or antimicrobial finish. In still further embodiments, the face cradle cover could be made from fabrics or other materials that are washable and reusable. Further embodiments may also be constructed from disposable fabrics or other disposable materials (e.g., plastics, latex). One of ordinary skill in the art would appreciate there are a number of materials and fabrics that would be suitable for constructing the face cradle cover with protective storage element, and embodiments of the present invention are contemplated for use with any such material or fabric.

According to an embodiment of the present invention, the face cradle cover with protective storage element is comprised of a face cradle cover portion. In a preferred embodiment, the face cradle cover portion is primarily comprised of a cover wall, one or more cover wall securing means, and one or more pocket attachment means. In an alternate embodiment, the face cradle cover portion may be comprised of additional or fewer components. In the preferred embodiment, the face cradle cover portion is adapted to surround and cover the face cradle of the massage table in order to provide a protective, hygienic barrier between the face and/or head of a user and the surface of the face cradle. In some embodiments, the face cradle cover may be substantially tailored to tightly fit a particular face cradle. In some embodiments, the face cradle cover may be loosely fitted to provide a universal fit with a number of different face cradles. One of ordinary skill in the art would appreciate that a face cradle cover could be designed in a number of configurations, and embodiments of the present invention are contemplated for use with any such configuration.

According to an embodiment of the present invention, the face cradle cover portion is comprised of a cover wall. In a preferred embodiment, the cover wall is one or more sections of material or fabric that are adapted to envelop the face cradle of a massage table. In the preferred embodiment, the cover wall may take the form of a shell or sleeve-like component that includes one or more openings that are adapted to allow the cover wall to slide on or over the face cradle of the massage table. In the preferred embodiment, the cover wall may be comprised of a single section of material that is appropriately formed and designed to be sewn, fused, sealed, or otherwise connected to form the cover wall. In an alternate preferred embodiment, the cover wall may be comprised of a plurality of sections of material that are each appropriately formed and designed to be sewn, fused, sealed or otherwise connected together to construct a cohesive unit that forms a cover wall. One of ordinary skill in the art would appreciate that there are many suitable design configurations for a cover wall, and embodiments of the present invention are contemplated for use with any such design configuration.

According to an embodiment of the present invention, the face cradle cover portion is comprised of one or more cover wall securing means. In a preferred embodiment, the cover wall securing means is attached at the one or more openings on the cover wall. In the preferred embodiment, the cover wall securing means are adapted to firmly secure the cover wall to the face cradle of the massage table. In the preferred embodiment, the cover wall securing mean may cause the cover wall to substantially enclose the face cradle by forming a shell around the portions of the face cradle that would come into contact with the face and/or head of a user. In an alternate preferred embodiment, the cover wall securing means may cause the cover wall to fully enclose the face cradle by forming a fully-sealed sleeve that completely covers the face cradle. In the preferred embodiment, a number of items could be used as cover wall securing means, including, but not limited to, elastic elements, zippers, claps, buttons, hook-and-loop fasteners, snap closures, magnets, or any other suitable connector or flexible fitting element. One of ordinary skill in the art would appreciate that there are a number of items that could be suitably used as a cover wall securing means, and embodiments of the present invention are contemplated for use with any such item. Further, one of ordinary skill in the art would appreciate that the securing means could be formed, integrated or secured on any side or potion of the face cradle cover (e.g., top, bottom, left side, right side, front, back), and embodiments of the present invention are contemplated for use with all configurations of securing means.

According to an embodiment of the present invention, the face cradle cover portion is comprised of one or more pocket attachment means. In a preferred embodiment, the one or more pocket attachment means are fixed to either the inner or the outer surface of the cover wall. In the preferred embodiment, the one or more pocket attachment means are configured to connect the face cradle cover portion to the protective storage element. In the preferred embodiment, a variety of connectors might be used for the one or more pocket attachment means, including, but not limited to, hook-and-loop fasteners, buttons, snap closures, claps, and magnets. One of ordinary skill in the art would appreciate a number of connectors would be suitable to use as pocket attachment means, and embodiments of the present invention are contemplated for use with any such connector. Further, one of ordinary skill in the art would appreciate that the pocket attachment means could be formed, integrated or secured on any side or potion of the face cradle cover (e.g., top, bottom, left side, right side, front, back), and embodiments of the present invention are contemplated for use with all configurations of pocket attachment means.

According to an embodiment of the present invention, the face cradle cover with protective storage element is comprised of a protective storage element. In a preferred embodiment, the protective storage element is primarily formed as a pocket of any shape or size and is further comprised of one or more cover portion attachment means. In an alternate embodiment, the protective storage element may be comprised of additional or fewer components. In the preferred embodiment, the protective storage element is adapted to cover areas of the massage table that are adjacent to the face cradle of the massage table in order to provide a protective, hygienic barrier between the face and/or head of a user and, in particular, the front edge of the massage table top, as well as other exposed portions of the massage table and face cradle in that area. One of ordinary skill in the art would appreciate that a protective storage element could be designed in a number of configurations, and embodiments of the present invention are contemplated for use with any such configuration.

According to an embodiment of the present invention, the protective storage element is formed as a pocket. In a preferred embodiment, the pocket is adapted to receive the face cradle cover for storage and transport. In the preferred embodiment, the pocket has two primary purposes, each of which has been previously discussed, but are described again for the clarity. First, the pocket serves a storage function, as the face cradle cover portion can be folded and stowed inside of the pocket during storage and transport. Second, the pocket also provides a protective function in that it serves as a cover or barrier that drapes over exposed portions of the massage table that are adjacent to the face cradle. In an additional preferred embodiment, the pocket may also be used for storage when it is being used in a protective function. In that preferred embodiment, as the pocket is draped over the front edge of the massage table, the pocket can be used to store items that belong to the user, including, but not limited to, scented sachets, aromatherapy items, and personal electronic devices. One of ordinary skill in the art would appreciate that there are many functions and configurations that the pocket might embody, and embodiments of the present invention are contemplated for use with any such function or configuration.

According to an embodiment of the present invention, the protective storage element is comprised of one or more cover portion attachment means. In a preferred embodiment, the one or more cover portion attachment means are fixed to the outer surface of the pocket forming the protective storage element. In the preferred embodiment, the one or more cover portion attachment means are configured to connect the face cradle cover portion to the protective storage element. In the preferred embodiment, a variety of connectors might be used for the one or more cover portion attachment means, including, but not limited to, hook-and-loop fasteners, buttons, snap closures, claps, and magnets. One of ordinary skill in the art would appreciate a number of connectors would be suitable to use as cover portion attachment means, and embodiments of the present invention are contemplated for use with any such connector. Further, one of ordinary skill in the art would appreciate that the cover portion attachment means could be formed, integrated or secured on any side or potion of the face cradle cover (e.g., top, bottom, left side, right side, front, back), and embodiments of the present invention are contemplated for use with all configurations of cover portion attachment means.

According to an embodiment of the present invention, the pocket of the protective storage element is connected to the face cradle cover portion. In the preferred embodiment, there are many alternatives as to how this connection might be achieved, but the connection is primarily achieved by connecting a first end of the protective storage element to a first end of the face cradle cover portion and a second end of the protective storage element to a second end of the face cradle cover portion. In a first preferred embodiment, one of the connections is a permanent connection point and the other is a detachable connection. In second preferred embodiment, both connections are detachable. In third preferred embodiment, both connections are permanent. In embodiments where the connection is permanent, the connection might be accomplished by connecting the protective storage element and face cradle cover portion together with a stitch. Alternatively, the permanent connection might be achieved with a rivet. In embodiments where the connection is detachable, the connection might be accomplished by connecting the one or more cover portion attachment means of the protective storage element to the one or more pocket attachment means of the face cradle cover. One of ordinary skill in the art would appreciate that there are many methods that might be used to connect the pocket to the face cradle cover portion, and embodiments of the present invention are contemplated for use with any such connection method.

According to an embodiment of the present invention, the pocket may further include a protective lining on one or more of the interior of the pocket or the exterior walls of the pocket. A first purpose of the protective lining is configured to create a protective barrier on or inside the pocket such that the pocket is protected from damage or contamination that could be caused through the use of the pocket (e.g., spillage of oils or other liquids, saliva or other contaminants). The protective lining may be secured to the walls of the pocket in such a manner that one or more individual pockets are formed within or upon the exterior walls of the pocket. This embodiment provides the second functionality of allowing for multiple pockets to be formed and allow for the separation and containment of numerous items. In preferred embodiments, the protective lining could be formed from a material such as plastic, fabric, linen, vinyl and rubber. In other embodiments, the protective lining could be formed from cloths, fabrics or other appropriate materials. One of ordinary skill in the art would appreciate that there are numerous materials and manners in which the protective lining could be secured to form any number of pockets within or upon the pocket, and embodiments of the present invention are contemplated for use with any such material or configuration.

Exemplary Embodiment

According to an embodiment of the present invention, the face cradle cover with protective storage element is adapted to cover the face cradle and adjacent areas of massage table. In a preferred embodiment, the face cradle cover portion of the face cradle cover with protective storage element is slipped over the face cradle of a massage table. Once the face cradle cover portion is in place on the face cradle of the massage table, the cover wall securing means of the face cradle cover portion will securely hold the face cradle cover potion in place on the face cradle. In some embodiments, the user may be required to connect, couple, join or otherwise close certain components of the cover wall securing means to ensure the most secure possible fit. In some embodiments, the cover wall securing means will be substantially secured by an elastic element that will be appropriately fitted to the face cradle. Next, the protective storage element is placed as appropriate on the massage table. In the preferred embodiment, this entails draping the protective storage element over the front edge of the top of the massage table, as well as any other adjacent areas that might also be coverable. In the preferred embodiment, the protective cover element is permanently attached to one end of the face cradle cover portion, but then must also be reversibly attached to the opposite end of the face cradle cover portion. In the preferred embodiment, this is achieved by reversibly connecting the pocket attachments means of the face cradle cover to the cover portion attachment means of the protective storage element. When the user is finished using the cover, the steps may be executed substantially in reverse and the face cradle cover portion may be folded and stowed away in the pocket that is formed by the protective storage element.

Turning now to FIG. 1, a front view of a face cradle cover with protective storage element, in accordance with an embodiment of the present invention. In a preferred embodiment, the face cradle cover with protective storage element 100 is comprised of a face cradle cover portion 102 and a protective storage element 112. The face cradle cover portion 102 is further comprised of a cover wall 104, cover wall securing means 106, and pocket attachment means 108. The protective storage element 112 is further comprised of a pocket 114 and cover portion attachment means 116. The face cradle cover portion 102 is connected to the protective storage element 112 by at least a connection point 110.

Figure 2:
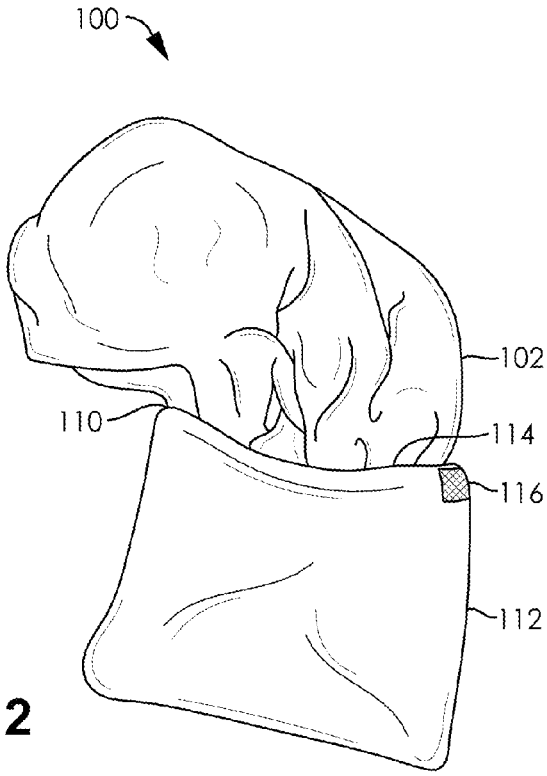
FIG. 2 is a front view of a face cradle cover partially stowed within the protective storage element in accordance with an embodiment of the present invention.

Turning now to FIG. 2, a front view of a face cradle cover partially stowed within the protective storage element, in accordance with an embodiment of the present invention. In a preferred embodiment, the face cradle cover portion 102 can be folded and stored inside of the pocket 114 of the protective storage element 112.

Figure 3:
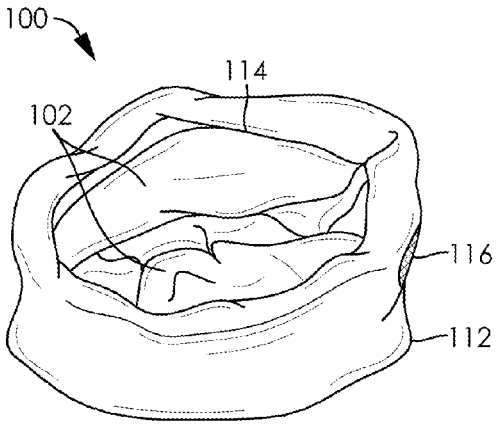
FIG. 3 is a top view of a face cradle cover stowed within the protective storage element in accordance with an embodiment of the present invention.

Turning now to FIG. 3, a top view of the face cradle cover stowed inside the protective storage element, in accordance with an embodiment of the present invention. In a preferred embodiment, the face cradle cover portion 102 can be folded and stored inside of the pocket 114 of the protective storage element 112.

Figure 4:
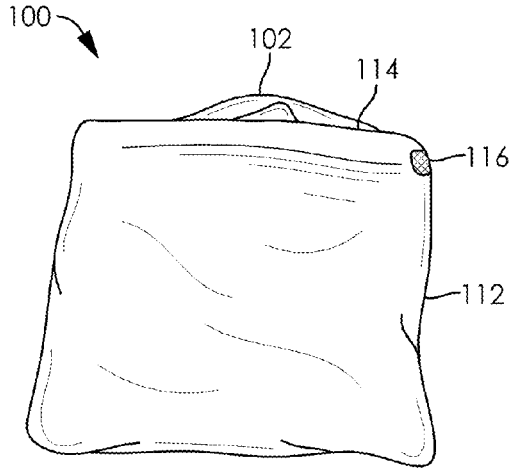
FIG. 4 is front view of a face cradle cover stowed within the protective storage element in accordance with an embodiment of the present invention.

Turning now to FIG. 4, a front view of the face cradle cover stowed inside the protective storage element, in accordance with an embodiment of the present invention. In a preferred embodiment, the face cradle cover portion 102 can be folded and stored inside of the pocket 114 of the protective storage element 112.

Figure 5:
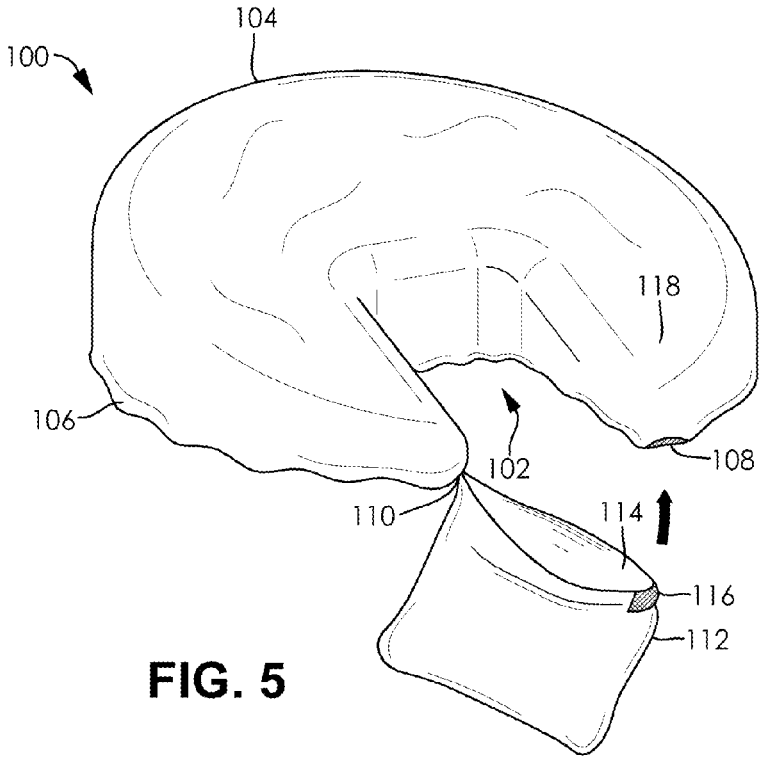
FIG. 5 is illustration of a face cradle cover with protective storage element in place on a face cradle of a massage table in accordance with an embodiment of the present invention.

Turning now to FIG. 5, an illustrative example of a face cradle cover with protective storage element in place on a face cradle of a massage table, in accordance with an embodiment of the present invention. In a preferred embodiment, the face cradle cover portion 102 is positioned on the face cradle 118 and the face cradle cover portion 102 is attached to the protective storage element 112 via a connection point 110. The cover wall securing means 106, firmly attaches the face cradle cover 102 to the face cradle 118. To fully secure the face cradle cover portion 102 to the protective storage element 112, the pocket attachment means 108 on the face cradle cover portion 102 can be connected to the cover potion attachment means 116 of the protective storage element 112.

Figure 6:
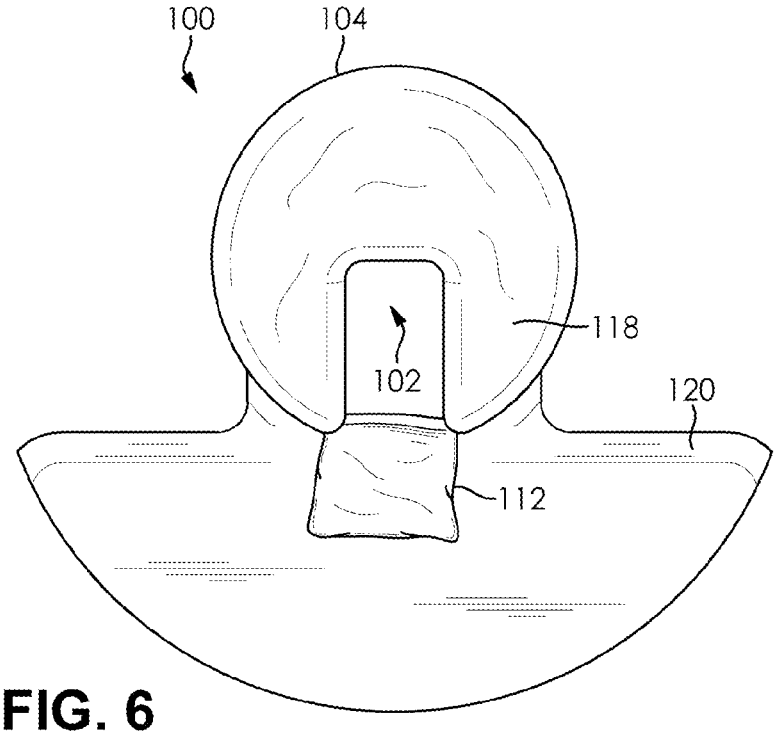
FIG. 6 is illustration of a face cradle cover with protective storage element in place on a massage table in accordance with an embodiment of the present invention.

Turning now to FIG. 6, an illustrative example of a face cradle cover with protective storage element in place on a massage table, in accordance with an embodiment of the present invention. In a preferred embodiment, the face cradle cover portion 102 is positioned on the face cradle 118 at the front edge of the massage table 120 and the face cradle cover portion 102 is attached to the protective storage element 112 via a connection point. The cover wall securing means, firmly attaches the face cradle cover 102 to the face cradle 118. To fully secure the face cradle cover portion 102 to the protective storage element 112, the pocket attachment means on the face cradle cover portion 102 can be connected to the cover potion attachment means of the protective storage element 112.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A face cradle cover with protective storage element, comprising:

a face cradle cover portion, comprising a cover wall configured to envelop a face cradle, one or more cover wall securing means configured to secure said cover wall to said face cradle, and one or more pocket attachment means attached to one or more of an inner surface and an outer surface of said cover wall; and a protective storage element formed as a pocket adapted to receive said face cradle cover within said pocket and said protective storage element further comprising one or more cover portion attachment means attached to one or more of an inner surface and an outer surface of said protective storage element, wherein said one or more cover portion attachment means is adapted to connect said storage pocket to said one or more pocket attachment means of said face cradle cover portion.

2. The face cradle cover with protective storage element of claim 1, wherein said protective storage element is further adapted to serve as a protective cover for exposed portions of a massage table and any hardware attachments such as from a face cradle adjacent to said face cradle.

3. The face cradle cover with protective storage element of claim 1, wherein said pocket of said protective storage element is further adapted to store items when said face cradle cover portion is in place on said face cradle.

4. The face cradle cover with protective storage element of claim 1, wherein said one or more cover wall securing means is selected from a group of cover wall securing means comprising an elastic element, a zipper, a one or more clasps, one or more buttons, a one or more hook-and-loop fasteners, or one or more snap closures.

5. The face cradle cover with protective storage element of claim 1, wherein said one or more pocket attachment means are selected from a group of attachment means comprising hook-and-loop fasteners, buttons, snap closures, claps, and magnets.

6. The face cradle cover with protective storage element of claim 1, wherein said one or more cover portion attachment means are selected from a group of attachment means comprising hook-and-loop fasteners, buttons, snap closures, claps, and magnets.

7. A face cradle cover with protective storage element, comprising:

a face cradle cover portion, comprising a cover wall configured to envelop a face cradle, one or more cover wall securing means configured to secure said cover wall to said face cradle, and one or more pocket attachment means attached to one or more of an inner surface and an outer surface of said cover wall; and a protective storage element formed as a pocket adapted to receive said face cradle cover within said pocket and said protective storage element further comprising one or more cover portion attachment means attached to one or more of an inner surface and an outer surface of said protective storage element, wherein said one or more cover attachment means is adapted to connect said protective storage element to said one or more pocket attachment means of said face cradle cover portion, wherein said protective storage element is permanently attached to said face cradle cover portion via one or more connection points.

8. The face cradle cover with protective storage element of claim 7, wherein said one or more connection points is a stitch connecting between said protective storage element and said face cradle cover portion.

9. The face cradle cover with protective storage element of claim 7, wherein said protective storage element is further adapted to serve as a protective cover for exposed portions of a massage table and face cradle hardware adjacent to said face cradle.

10. The face cradle cover with protective storage element of claim 7, wherein said pocket of said protective storage element is further adapted to store items when said face cradle cover portion is in place on said face cradle.

11. The face cradle cover with protective storage element of claim 7, wherein said one or more cover wall securing means is selected from a group of cover wall securing means comprising an elastic element, a zipper, a one or more clasps, one or more buttons, one or more hook-and-loop fasteners, or one or more snap closures.

12. The face cradle cover with protective storage element of claim 7, wherein said one or more pocket attachment means are selected from a group of attachment means comprising hook-and-loop fasteners, buttons, snap closures, claps, and magnets.

13. The face cradle cover with protective storage element of claim 7, wherein said one or more cover portion attachment means are selected from a group of attachment means comprising hook-and-loop fasteners, buttons, snap closures, claps, and magnets.

14. The face cradle cover with protective storage element of claim 7, wherein said pocket further comprises an interior lining.

15. The face cradle cover with protective storage element of claim 14, wherein said interior lining is constructed from a protective material, selected from the group comprising plastic, fabric, linen, vinyl and rubber.

16. The face cradle cover with protective storage element of claim 14, wherein said interior lining is formed to provide a plurality of individual pockets within said pocket.

17. The face cradle cover with protective storage element of claim 7, wherein said pocket further comprises an exterior lining.

18. The face cradle cover with protective storage element of claim 17, wherein said exterior lining is constructed from a protective material, selected from the group comprising plastic, fabric, linen, vinyl and rubber.

19. The face cradle cover with protective storage element of claim 17, wherein said exterior lining is formed to provide a plurality of individual pockets on one or more external walls of said pocket.

* * * * *